US006123361A

United States Patent [19]

Cohen

[11] Patent Number: 6,123,361

[45] Date of Patent: Sep. 26, 2000

[54] PROMOTIONAL ARTICLE

[75] Inventor: Marcia L. Cohen, New York, N.Y.

[73] Assignee: Graphic Distinctions, Inc., New York, N.Y.

[21] Appl. No.: 09/216,687

[22] Filed: Dec. 18, 1998

[51] Int. Cl.[7] ..... G09F 29/00

[52] U.S. Cl. ..... 283/56; 229/70; 229/71; 283/71; 283/116

[58] Field of Search ..... 283/56, 71, 116; 229/70, 71

[56] References Cited

U.S. PATENT DOCUMENTS

| | | | |
|---|---|---|---|
| 549,307 | 11/1895 | Bear . | |
| 866,172 | 9/1907 | Westphall . | |
| 4,597,591 | 7/1986 | Gendron et al. | 283/1 |
| 5,251,810 | 10/1993 | Kim | 229/303 |
| 5,704,543 | 1/1998 | Pollanen | 229/303 |
| 5,894,986 | 4/1999 | Lederman et al. | 229/71 |
| 5,927,592 | 7/1999 | Kranz | 229/71 |

*Primary Examiner*—Willmon Fridie, Jr.
*Assistant Examiner*—Monica S. Carter
*Attorney, Agent, or Firm*—Darby & Darby

[57] ABSTRACT

A promotional mailing in the form of an envelope having an insert with a promotional message and a simulated reward item, i.e., an item which substantially simulates in shape, size and coloration an actual item having a recognizable, tenderable value, such as a postage stamp or currency. The simulated reward item is at least partially displayed through a window in the envelope such that a consumer viewing the envelope will perceive the simulated item to be an actual item having value. In order to access the simulated reward positioned in the envelope, the consumer must open the envelope, and is thereby more likely to be exposed to the promotional message conveyed by the insert in the envelope. The simulated reward item may be inexpensively printed directly on the sheet material of the insert. The simulated reward item may be enhanced to appear more like an actual reward item by embossing the sheet material to simulate edges on the reward item. To prevent the simulated reward item from being confused with an actual reward item, the simulated reward item is provided with a visual cue in the form of a portion of the item which is missing, obscured or overprinted. The visual cue is positioned on the simulated reward item, and the simulated reward item is positioned in the window of an envelope such that the visual cue is not readily apparent or visible from the exterior of the package. The visual cue only becomes visible or apparent after the insert has been removed from the envelope, and the simulated reward item is inspected more closely.

20 Claims, 2 Drawing Sheets

PROMOTIONAL ARTICLE

BACKGROUND OF THE INVENTION

1. Field of the Invention

The present invention relates generally to an article that can be used for promotional or advertising purposes, and relates specifically to a promotional mailing article having a printed part which simulates at least a portion of an item having a recognizable, tenderable value, such as, for example, a postage stamp or currency.

2. Description of Related Art

Direct mail promotions, generally consisting of printed materials conveying a promotional message, can be highly effective marketing tools if a consumer's attention is properly drawn to the information conveyed by the promotion. Some promotional mailings comprise a simple postcard conveying apromotional message. Other mailings are more complex, comprising packaging, such as, for example, an envelope, enclosing printed promotional materials in the form of inserts, each conveying one or more promotional messages. The envelope may also contain additional materials, hereinafter referred to as convenience inserts, such as, for example, pre-printed order forms and pre-addressed and postage paid return envelopes for the convenience of consumers who wish to respond to the promotional mailing.

Due to the large volume of direct mail promotions received daily by consumers, direct mail promotions may have limited effectiveness with consumers that perceive the promotional mailings to be a nuisance. These consumers may discard the promotional mailings after merely glancing at the mailing to determine it's origin or nature. This is particularly a problem for more complex mailings delivered in packages because the mailing may be discarded unopened, i.e., before the consumer is exposed to the message conveyed by the promotional material contained in the package. Thus, the promotional message conveyed in the mailing goes unread and unheeded.

Direct mail marketers have found that the effectiveness of a direct mail marketing campaign can be significantly increased by compelling more consumers to actually open a promotional mailing before discarding it, thus drawing the attention of more consumers to the message conveyed by contents of the package. This is accomplished by providing a visual incentive or "reward" to entice the consumer to open the package. To draw the consumer's attention, the "reward" is generally an item having an immediately recognizable, and preferably, a tenderable value. In the context of the present application, "tenderable value" indicates that an item may be redeemable for a known value. Items having tenderable value include, for example, postage stamps, or money in the form of bills or coins. The "reward" item is enclosed in a direct mail package in such a way that the consumer can see the "reward" item by merely glancing at the promotional package, i.e., without first opening the package, but must open the package to have access to the item. Because the consumer can immediately identify the "reward" as an item of value, the consumer is less likely to discard the mailing unopened. Since the consumer must open the promotional package to retrieve the "reward", it is believed that the promotional mailing will be more effective because, by opening the package, the consumer is exposed to the promotional message conveyed by the contents of the package.

Generally, the "reward" is positioned anywhere on or in the package such that it is prominently visible by merely glancing at the outside of the package. Although, the "reward" may be positioned anywhere on or in the package, it is preferably positioned so that it is visible from the front of the package, i.e., the address label side of the package. This is usually accomplished by fastening the "reward" to a piece of promotional material contained in the package such that the "reward" is displayed in an opening or a window on the front of the package. The opening or window may be the address window of the package, or may be another opening or window, such as, for example, a separate window solely for display of the "reward" item.

Although mailings containing a "reward" item have been shown to be effective marketing tools, providing a "reward" item in each package of a promotional mailing can significantly increase the cost of a marketing campaign. For example, each promotional package has a base "per-package" cost computed by adding production costs, i.e., preparing and printing the promotional materials and related convenience items and assembling them in a mail-able promotional package, and mailing costs. The cost of enclosing a "reward" in the package significantly increases the per-package cost of each package. If, for example, the "reward" item is a first class postage stamp, the cost for each promotional package is increased by $0.32. In a marketing campaign involving the mass mailing of large quantities of individual promotional packages, this additional per package cost can significantly increase the cost of the marketing campaign.

As a result, there is a need for an article that will entice consumers to open a promotional package without incurring the high per package cost of enclosing an actual "reward" item.

SUMMARY OF THE INVENTION

The present invention provides a promotional article having a simulated reward item, i.e., an item which substantially simulates in shape, size and coloration an actual item having a recognizable, tenderable value, such as, for example, a postage stamp or currency. The simulated reward is positioned on or in a promotional mailing such that a consumer's attention is more likely to be drawn to the promotional message conveyed by the promotional article. In the case of a promotional article forming part of a promotional package, the simulated reward is preferably positioned and attached inside of the package, but is visible from the exterior of the package through an opening or window in the package such that a consumer glancing at the package will be enticed to examine the package more closely. In order to access the simulated reward positioned in the package, the consumer must open the package, and is thereby more likely to be exposed to the message conveyed by the promotional materials in the package.

The simulated reward item may be inexpensively printed directly on a sheet material such as paper, preferably together with a promotional message printed directly on the same sheet material. The simulated reward item may be enhanced to appear more like an actual award item by, for example, embossing the sheet material to simulate edges on the simulated reward item.

As noted above, the simulated reward item substantially resembles an actual reward item. However, to prevent the simulated reward item from being confused with an actual reward item, the simulated reward item differs from an actual item by way of a visual cue which preferably only becomes visible or obvious upon opening of the promotional package. For example, the simulated reward item may appear substantially identical to an actual reward item except for a visual cue in the form of a corner portion of the item which is missing or obscured or overprinted. The visual cue is positioned on the simulated reward item, and the simulated reward item is positioned in the window of a promotional package such that the visual cue is not readily apparent or visible from the exterior of the package. The visual cue preferably only becomes visible or apparent after the promotional package is opened, and the simulated reward item is inspected more closely.

The invention is suitable for use in all manor of promotional mailings for increasing the effectiveness of a marketing campaign by drawing the attention of more consumers to the message conveyed by the mailings. Examples of particular direct mail portions contemplated by the inventor include, but are not limited to, magazine renewals, billing or new subscription solicitations.

BRIEF DESCRIPTION OF THE DRAWINGS

The objects of the present invention will be more fully understood when taken in conjunction with the following detailed description of the preferred embodiment in which like numerals represent like elements and in which.

DETAILED DESCRIPTION OF THE PREFERRED EMBODIMENT

Figure 1:
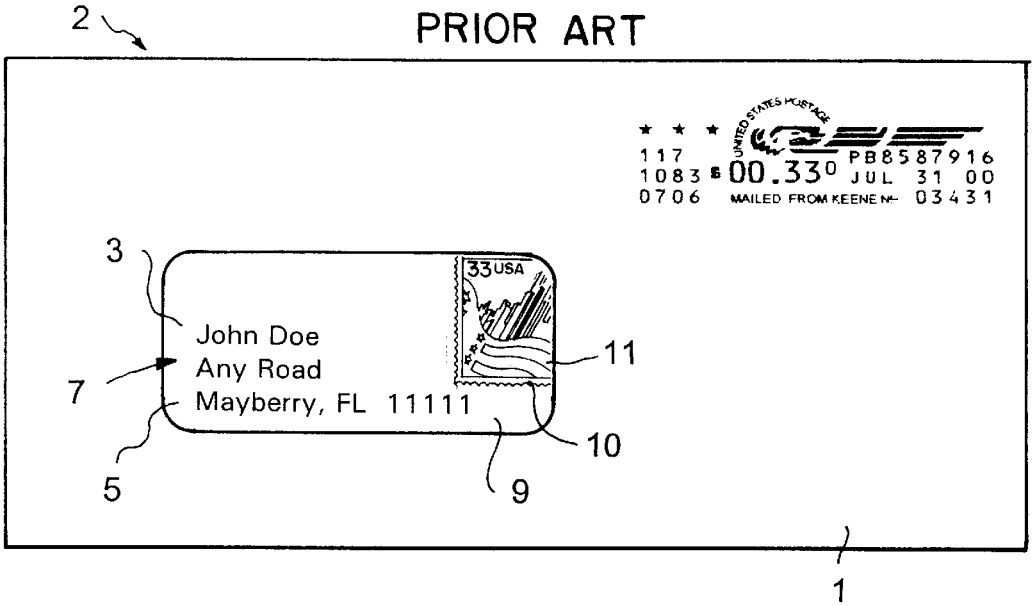
FIG. 1 PRIOR ART
FIG. 1 is a front elevational view of a prior art promotional mailing package enclosing an insert.

As shown in FIG. 1, a prior art promotional mailing 2 is comprised of a package 1 in the form of an envelope containing a sheet-like insert 3 having personalization indicia 7 imprinted in one or more locations thereon by methods well known in the art, such as, for example, by lazer printing (also known as "lasering"). The insert 3 supports a reward item 10 on a surface 9 thereof. The personalization indicia 7 on insert 3 convey important information which is customized based on the intended recipient, such as, for example, the intended recipient's name and address, as well as subscription cost, terms or discount, etc., and may also convey a nonpersonalized promotional message. The envelope 1 has an address window 5 sized to permit display of at least a portion of the personalization indicia 7 and which is cooperatively aligned with the portion of insert 3 having personalization indicia 7. Other portions of the insert 3 may also be externally visible through the window 5 in the envelope. At least part of reward item 10 is clearly visible through the window 5. The reward item 10 is an item immediately recognizable as an item having a tenderable value, such as, for example, a postage stamp or a coin, and does in fact have a redeemable value. Furthermore, a sufficient portion of the reward item 10 is visible in the window 5 to permit a viewer to recognize the item. In the prior art promotional mailing shown in FIGS. 1 and 2, the reward item 10 is a postage stamp 11, also referred to as a "live stamp" because it has actual tenderable value.

Figure 2:
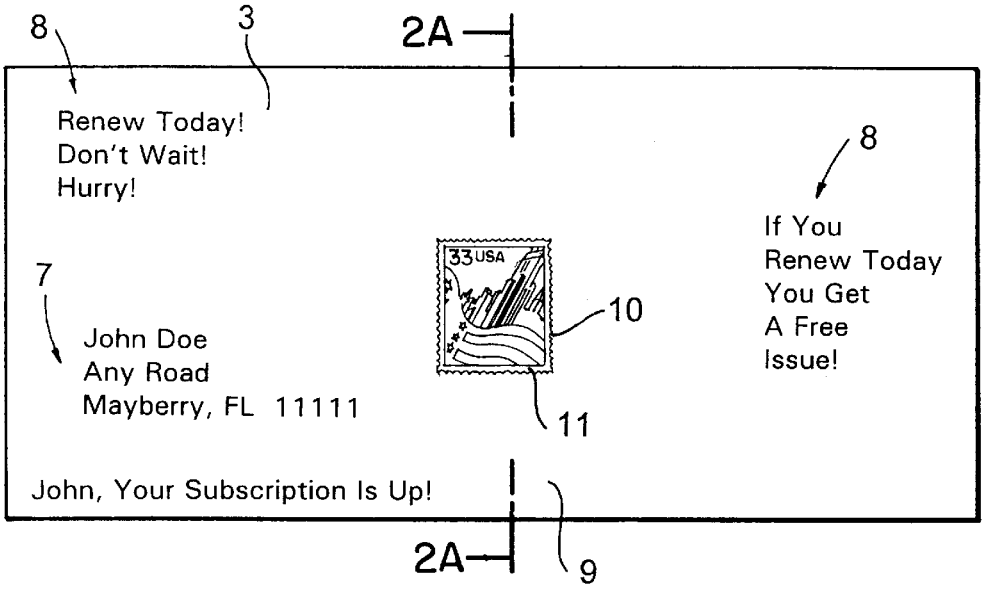
FIG. 2 PRIOR ART
FIG. 2 is a front elevational view of the prior art insert removed from the promotional mailing package shown in FIG. 1.
Figure 2A:
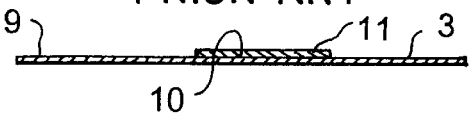
FIG. 2A PRIOR ART
FIG. 2*a* is a cross-sectional view taken along sectional line 2—2 of FIG. 2.

Referring to FIG. 2, the entire front surface 9 of insert 3 is shown, insert 3 having been removed from the envelope 1 of FIG. 1. The personalization indicia 7 is shown. Because the insert 3 is removed from the envelope 1, the reward item 10 is visible in its entirety, i.e., it is no longer partially obscured by an edge of the window 5 of the envelope 1. Insert 3 may have additional indicia 8 imprinted thereon conveying non-personalized information, such as, for example, a non-personalized promotional message or messages. All or a portion of the indicia 8 may also appear in the window 5 or in other windows in the envelope 1. The window 5 or other windows in envelope 1 may be selected to be any suitable size. The indicia 8 conveying additional messages are preferably positioned immediately adjacent to the reward item 10 so that a consumer is more likely to see any promotional message(s) upon closer inspection of the reward item 10. The reward item 10 is removably attached to the insert 3, so that the consumer can detach the reward item 10 and redeem it for cash value or otherwise use it.

Placement of the reward item 10 on the insert 3 such that it is at least partly visible in window 5 of the envelope 1 thus entices the consumer to open the envelope 1 and may lead to the consumer reading the promotional messages.

Figure 3:
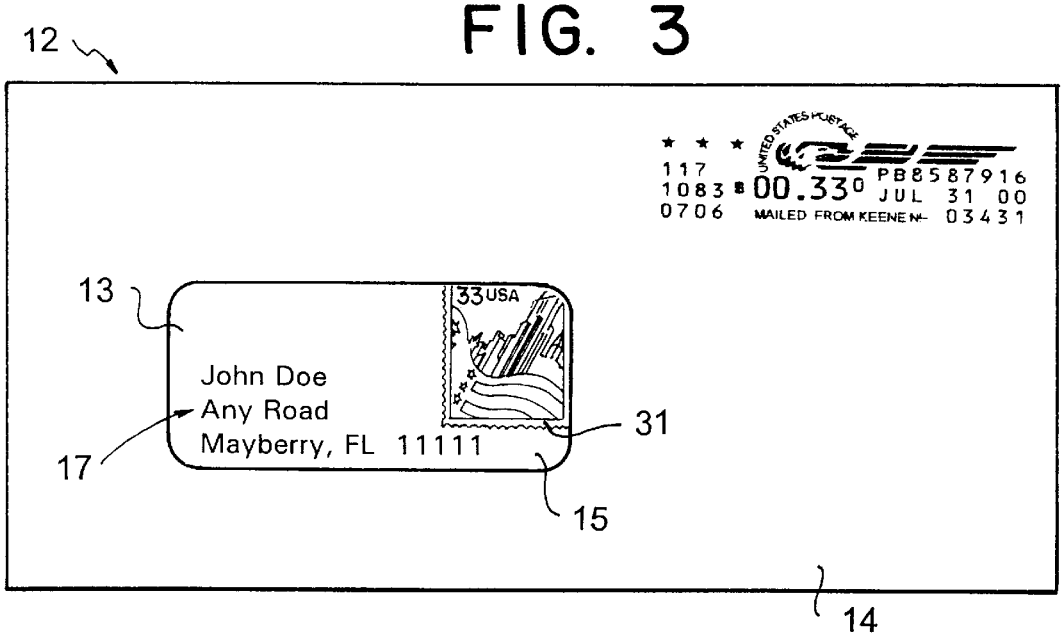
FIG. 3 is a front elevational view of a promotional mailing package enclosing an insert according to the present invention.

Referring now to FIG. 3, the promotional mailing 12 of the present invention is comprised of a package in the form of an envelope 14 containing a sheet-like insert 13 having a front surface 19. Personalization indicia 17 is imprinted on surface 19 by well known methods and a simulated reward item 20 is provided on surface 19. The personalization indicia 17 on insert 13 convey important information such as, for example, the recipient's name, address, etc. and also may convey a personalized promotional message. The envelope 14 has an address window 15 and/or other windows (not shown) suitably sized and positioned to display portions of insert 13 having personalization indicia 17, such that at least a pertinent part of the personalization indicia is visible in the window 15 when viewed from the outside of the envelope 14. Other portions of the insert 13 such as indicia 18 conveying non-personalized information, may also be externally visible through the window 15 or other windows in envelope 14. At least a recognizable part of the simulated reward item 20 is clearly visible through the window 15 when viewed from the outside of the envelope 14. Alternatively, at least a recognizable part of the reward item 20 may be visible through another window or windows (not shown) in envelope 14. The reward item 20 simulates an item immediately recognizable as having a tenderable value, such as, for example, a postage stamp or a coin. Since the simulated reward item 20 is merely a simulation of a tenderable item, reward item 20 does not in fact have a tenderable or redeemable value, and the cost of providing the simulated reward item 20 in the promotional package is minimal. Preferably, when viewed through window 15, or another window in the envelope, a sufficient portion of the simulated reward item 20 should be visible and should be sufficiently similar to an actual tenderable item such that a viewer will perceive the simulated reward item to be an actual reward item. In the promotional mailing shown, the simulated reward item 20 is a simulated postage stamp 31, also referred to as a "stamp visual" because it is a simulated postage stamp having no actual tenderable value.

Figure 7:
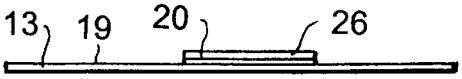
FIG. 7 is a cross-sectional view of an alternative embodiment taken along sectional line 6—6 in FIG. 4.
Figure 4:
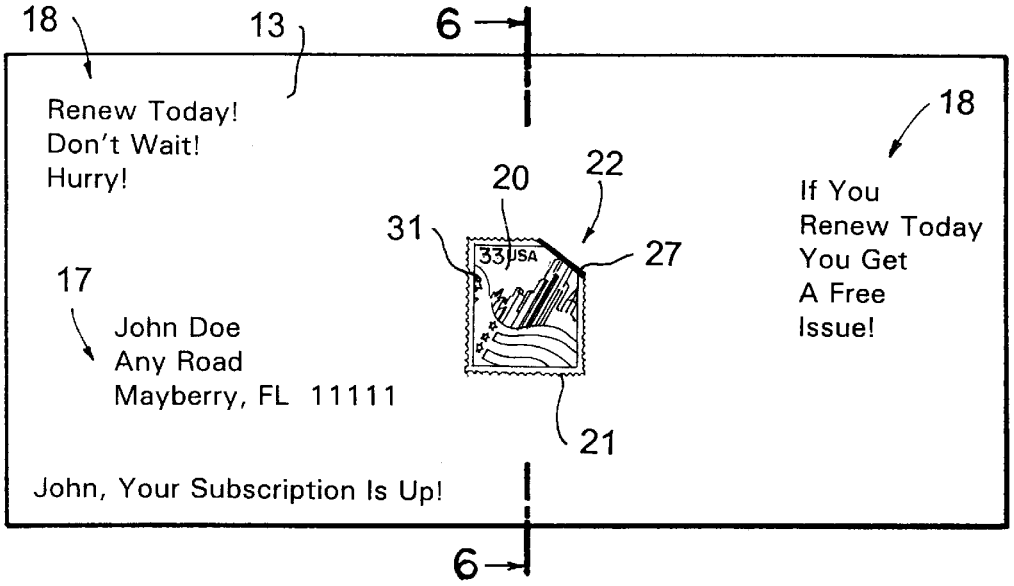
FIG. 4 is a front elevational view of the insert according to the invention removed from the promotional mailing package shown in FIG. 3.
Figure 6:
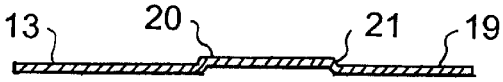
FIG. 6 is a cross-sectional view taken along sectional line 6—6 in FIG. 4.

Referring to FIG. 4, the insert 13 is shown, having been removed from the envelope 14 of FIG. 3. The personalization indicia 17 is shown on surface 19 of insert 13. Because the insert 13 is removed from the envelope 14, the simulated reward item 20, i.e., the stamp visual, is visible in its entirety, i.e., it is no longer partially obscured by an edge of window 15 of the envelope 14. Insert 13 may have additional indicia 18 conveying non-personalized information such as, for example, a promotional message or messages. The personalization indicia 17, and/or the indicia 18 conveying non-personalized information, are preferably positioned immediately adjacent to the simulated reward item 20 so that a consumer is more likely to see the promotional message(s), whether personalized or non-personalized, upon closer inspection of the simulated reward item 20. Preferably, the simulated reward item 20 is printed directly on the insert 13, using inks and printing techniques well known in the art, such that the simulated reward item substantially resembles an actual reward item in shape, size and coloration. In this manner, the simulated reward item may be inexpensively printed directly on surface 19 of insert 13 along with indicia conveying a promotional message. In addition, the resemblance to an actual reward item may be enhanced, for example, by embossing the insert 13 to provide an edge 21 in relief on surface 19 of insert 13 (See FIG. 6). Alternatively, the simulated reward item 20 may be printed on a separate sheet 26 (FIG. 7) such that it may be permanently or removably attached to the surface 19 of the insert 13 for a more realistic appearance.

Although the reward item 20 is preferably positioned so that it is visible when the front of the package is viewed, it may alternatively be positioned so that it is visible when a side or the back of the package is viewed. Placement of the simulated reward item 20 on the insert 13 such that it is at least partly visible from outside the envelope 14 thus entices the consumer to open the envelope 14 and may lead to the consumer reading the promotional messages conveyed in the materials in the envelope.

Figure 5:
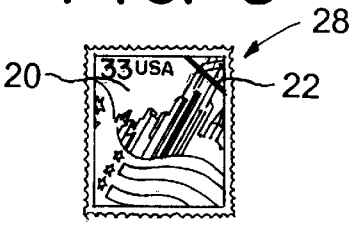
FIG. 5 is an alternate embodiment of a simulated reward item according to the invention.

As noted above, the simulated reward item 20 in FIGS. 3 and 4 substantially resembles an actual reward item. However, to prevent the simulated reward item 20 from being confused with an actual reward item, the simulated reward item 20 differs from the actual item by way of a visual cue 22 (FIGS. 4 and 5) which preferably only becomes visible or obvious upon removal of the insert 13 from the envelope 14. For example, the simulated reward item 20 may appear substantially identical to an actual reward item except for a visual cue 22 in the form of a corner portion 27 of the item which is missing (FIG. 4), or a portion 28 that is obscured or defaced by overprinting or other means (FIG. 5). The visual cue 22 is positioned on the simulated reward item 20, and the simulated reward item 20 is positioned in the window 15 of a promotional package such that the visual cue 22 is not readily apparent or visible from the exterior of the envelope 14. The visual cue 22 only becomes visible or apparent after the insert 13 is removed from the envelope 14, and the simulated reward item 20 is inspected more closely.

It will be understood that various embodiments and modifications other than as specifically shown and described herein are contemplated to be within the underlying concept of the invention, and therefore within the scope of the appended claims.

What is claimed is:

1. A promotional article removably positioned in an envelope, comprising:

a first printed part having a shape, a size and a coloration simulating at least a portion of an item having a recognizable, tenderable value, the first printed part having a display portion, the item further comprising a visual cue preventing confusion of the item with an item having actual tenderable value, wherein the visible cue is not visible from outside the envelope when the promotional article is positioned in the envelope and becomes visible upon opening of the envelope; and a second printed part having indicia conveying promotional information wherein the display portion of the first printed part is displayed to stimulate interest in said second printed part.

2. A promotional article according to claim 1 wherein the first printed part comprises a first sheet having at least one surface bearing printed matter.

3. A promotional article according to claim 2 wherein the second printed part comprises a second sheet having at least one surface bearing printed matter.

4. A promotional article according to claim 3 wherein the first sheet and the second sheet comprise a single integral sheet.

5. A promotional article according to claim 4 wherein the first printed part is embossed on the single integral sheet, whereby the first printed part appears to be separable from the second printed part.

6. A promotional article according to claim 1 wherein a portion of the first printed part is permanently obscured, whereby it is apparent that the item is a simulation.

7. A promotional article according to claim 6 wherein the obscured portion of the first part is obscured by overprinting.

8. A promotional article according to claim 6 wherein the obscured portion of the first part is obscured by an absence of a printed matter.

9. A promotional article according to claim 1 further comprising an envelope having a window, wherein the first printed part and the second printed part are removably positioned in the envelope such that the display portion of the first part is visible in the window.

10. A promotional article according to claim 6 further comprising an envelope having a window, wherein the first printed part and the second printed part are removably positioned in the envelope such that the display portion of the first part is visible in the window.

11. A promotional article according to claim 10 wherein the permanently obscured portion of the first printed part is not visible in the window.

12. A promotional article according to claim 1 wherein the item simulates a stamp.

13. A promotional article according to claim 1 wherein the item simulates a coin.

14. A promotional article removably positioned in an envelope, comprising:

a first printed part having a shape, a size and a coloration simulating at least a portion of an item having a recognizable, tenderable value, the first printed part having a display portion and a defaced portion, the defaced portion preventing confusion of the item with an item having actual tenderable value;

a second printed part having indicia conveying promotional information; and an envelope having a window, wherein the first printed part and the second printed part are removably positioned in the envelope such that the display portion of the first printed part is visible in the window and the defaced portion of the first printed part is not visible in the window which becomes visible upon opening of the envelope.

15. A promotional article according to claim 14 wherein the defaced portion of the first part is defaced by overprinting.

16. A promotional article according to claim 14 wherein the defaced portion of the first part is defaced by an absence of a printed matter.

17. An item having simulated tenderable value consisting of a simulated stamp and simulated currency for use with an envelope having a window and an insert with promotional message printed thereon, the item comprising a visible cue preventing confusion of the item with an item having actual tenderable value, the item being directly printed on the insert and immediately adjacent to the promotional message, wherein the visible cue of the item is not visible from outside the envelope when the insert is positioned in the envelope and becomes visible upon opening of the envelope.

18. The item of claim 17, wherein the visible cue consists of a printed matter and overprinting.

19. The item of claim 17, wherein the insert is a single integral sheet of paper and the item is embossed on the insert.

20. The item of claim 17, the insert further comprising personalized information consisting of name, address and non-promotional information printed thereon, wherein the personalized information is visible from outside of the envelope when the insert is positioned in the envelope.

* * * * *